US008992285B1

(12) United States Patent
Frantz, II

(10) Patent No.: US 8,992,285 B1
(45) Date of Patent: Mar. 31, 2015

(54) TOY VEHICLE SYSTEM

(71) Applicant: James L. Frantz, II, Clifton, CO (US)

(72) Inventor: James L. Frantz, II, Clifton, CO (US)

( * ) Notice: Subject to any disclaimer, the term of this patent is extended or adjusted under 35 U.S.C. 154(b) by 0 days.

(21) Appl. No.: 14/060,970

(22) Filed: Oct. 23, 2013

(51) Int. Cl.
*A63H 17/26* (2006.01)

(52) U.S. Cl.
CPC ..... *A63H 17/262* (2013.01)
USPC ..... 446/469

(58) Field of Classification Search
USPC ..... 446/431, 448, 451, 465, 466, 468, 469, 446/470, 471
See application file for complete search history.

(56) References Cited

U.S. PATENT DOCUMENTS

| | | | | |
|---|---|---|---|---|
| 3,811,218 | A * | 5/1974 | Salmon et al. | 446/94 |
| 4,120,118 | A * | 10/1978 | Mathews et al. | 446/144 |
| 4,696,655 | A | 9/1987 | D'Andrade et al. | |
| 4,822,316 | A | 4/1989 | Shaffer et al. | |
| 4,850,929 | A | 7/1989 | Genevey | |
| D305,555 | S | 1/1990 | Spielberger | |
| 5,643,041 | A * | 7/1997 | Mukaida | 446/455 |
| 5,762,533 | A * | 6/1998 | Tilbor et al. | 446/466 |
| 5,785,576 | A | 7/1998 | Belton | |
| 6,758,719 | B1 * | 7/2004 | Nava | 446/466 |
| 6,764,376 | B2 | 7/2004 | Agostini et al. | |
| 7,494,398 | B2 * | 2/2009 | Laurienzo | 446/454 |
| 8,079,892 | B2 * | 12/2011 | Wang et al. | 446/466 |
| 2005/0287920 | A1 * | 12/2005 | Lucas et al. | 446/454 |
| 2008/0261488 | A1 * | 10/2008 | Jabbour et al. | 446/466 |
| 2009/0036018 | A1 | 2/2009 | Woessner et al. | |
| 2012/0208429 | A1 * | 8/2012 | Sheridan et al. | 446/466 |

* cited by examiner

*Primary Examiner* — Kurt Fernstrom

(57) ABSTRACT

A toy vehicle system having interchanging wheels, tires and axles for altering ground clearance features a pair of anterior axle mount projections and a pair of posterior axle mount projections angularly located on a vehicle underside. Interchangeable anterior and posterior axle units are designed to position the toy vehicle at a ground clearance that proportionally resembles a full size vehicle ground clearance. The system features a first size plurality of wheels, a second size plurality of wheels, and a third size plurality of wheels, each having a tire located on an outer periphery thereon. The system features a plurality of fasteners for securing the anterior axle or the posterior axle. The system features a plurality of nuts located on wheel studs for securing a wheel on a hub. The system features a perpendicular wrench having four projections located thereon, radially projecting from a central hub.

5 Claims, 4 Drawing Sheets

TOY VEHICLE SYSTEM

FIELD OF THE INVENTION

The present invention relates to toy vehicles, or more specifically, toy vehicle with interchanging wheels, tires, and axles.

BACKGROUND OF THE INVENTION

Toy vehicle have existed for about as long as vehicles themselves have existed coming in a wide variety of configurations, colors, and sizes. Often a toy vehicle is a scaled down version of an actual full size vehicle. Four wheel drive and off-road type vehicles both in full size and toy varieties have increased in popularity during the past several decades. The present invention features a toy vehicle system having interchanging wheels, tires and axles for altering ground clearance for the vehicle with respect to an obstacle.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a toy vehicle system having interchanging wheels, tires and axles for altering ground clearance for the vehicle with respect to an obstacle. In some embodiments, the system comprises a toy vehicle having a vehicle underside. In some embodiments, the system comprises a pair of anterior axle mount projections angularly located on the vehicle underside parallel to each other. In some embodiments, the system comprises a pair of posterior axle mount projections angularly located on the vehicle underside parallel to each other.

In some embodiments, the system comprises a first anterior axle unit and a first posterior axle unit. In some embodiments, the first anterior axle unit and the first posterior axle unit are designed to position the toy vehicle at a toy vehicle standard ground clearance that proportionally resembles a full size vehicle standard ground clearance. In some embodiments, the system comprises a second anterior axle unit and a second posterior axle unit. In some embodiments, the second anterior axle unit and the second posterior axle unit are designed to position the toy vehicle at a toy vehicle second ground clearance that proportionally resembles a full size vehicle second ground clearance. In some embodiments, the system comprises a third anterior axle unit and a third posterior axle unit. In some embodiments, the third anterior axle unit and the third posterior axle unit are designed to position the toy vehicle at a toy vehicle third ground clearance that proportionally resembles a full size vehicle third ground clearance.

In some embodiments, the first anterior axle unit, the second anterior axle unit, and the third anterior axle unit each comprise an anterior axle first hub rotatably located on an anterior axle first end and an anterior axle second hub rotatably located on an anterior axle second end. In some embodiments, a pair of anterior axle mount sleeves are angularly located parallel to each other on the anterior axle. In some embodiments, a plurality of wheel studs is radially located on each of the first hub and the second hub. In some embodiments, the first posterior axle unit, the second posterior axle unit, and the third posterior axle unit each comprise a posterior axle first hub rotatably located on a posterior axle first end and a posterior axle second hub rotatably located on a posterior axle second end. In some embodiments, a pair of posterior axle mount sleeves are angularly located parallel to each other on the posterior axle. In some embodiments, a plurality of wheel studs is radially located on each of the first hub and the second hub.

In some embodiments, the system comprises a first size plurality of wheels, each having a first size tire located on an outer periphery thereon. In some embodiments, the first size plurality wheels and tires are designed to position the toy vehicle at the toy vehicle standard ground clearance that proportionally resembles a full size vehicle standard ground clearance. In some embodiments, the system comprises a second size plurality of wheels, each having a second size tire located on an outer periphery thereon. In some embodiments, the second size plurality wheels and tires are designed to position the toy vehicle at the toy vehicle second ground clearance that proportionally resembles the full size vehicle second ground clearance. In some embodiments, the system comprises a third size plurality of wheels, each having a third size tire located on an outer periphery thereon. In some embodiments, the third size plurality wheels and tires are designed to position the toy vehicle at the toy vehicle third ground clearance that proportionally resembles the full size vehicle third ground clearance.

In some embodiments, the system comprises a plurality of fasteners designed to pass through the fastening apertures for securing the anterior axle or the posterior axle to the anterior axle mount projection or the posterior axle mount projection. In some embodiments, the system comprises a plurality of nuts. In some embodiments, a nut is located on a wheel stud for securing the wheel on the hub.

In some embodiments, the system comprises a perpendicular wrench having four projections located thereon, radially projecting from a central hub. In some embodiments, a first projection comprises a flat blade screwdriver located on terminating end thereon for interfacing with the plurality of fasteners. In some embodiments, the second projection, the third projection, and the fourth projection comprise a lug wrench dispossessed on each terminating end thereon for interfacing with the plurality of nuts.

In some embodiments, the first anterior axle unit, the first posterior axle unit, and the first size plurality of wheels are located on the vehicle thereon. In some embodiments, alternately, the second anterior axle unit, the second posterior axle unit, and the second size plurality of wheels are located on the vehicle thereon. In some embodiments, alternately, the second anterior axle unit, the second posterior axle unit, and the second size plurality of wheels are located on the vehicle thereon.

DESCRIPTION OF PREFERRED EMBODIMENTS

Figure 1:
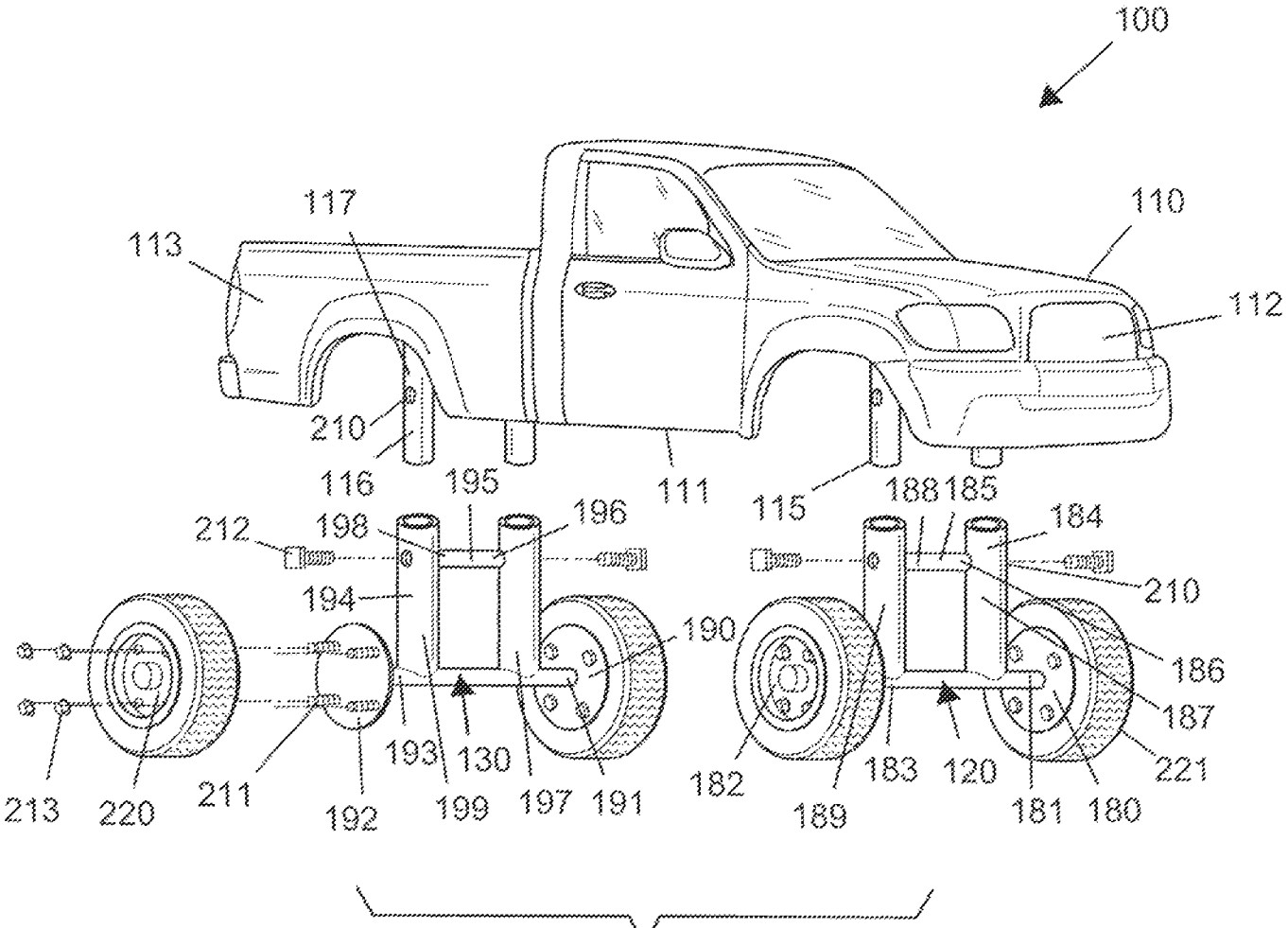
FIG. 1 shows an exploded view of the present invention.
Figure 2:
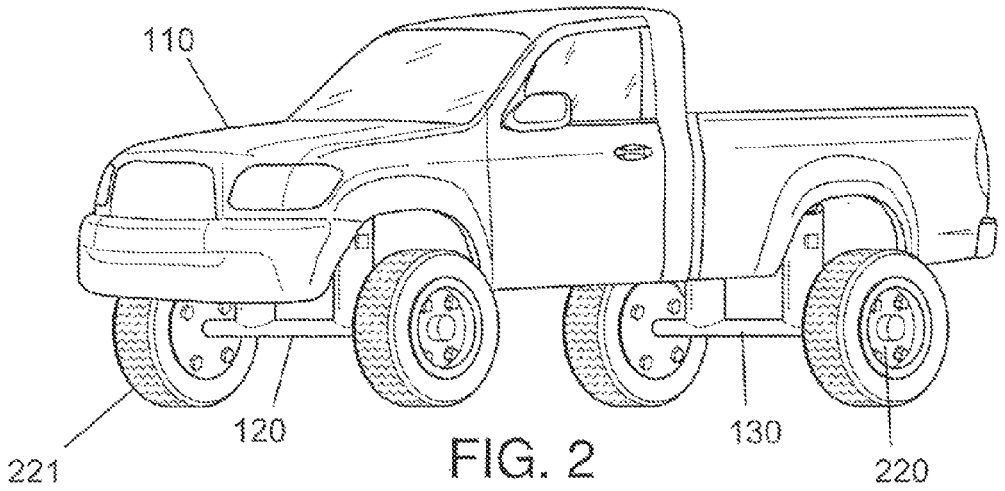
FIG. 2 shows a perspective view of the present invention featuring the toy vehicle standard ground clearance
Figure 3:
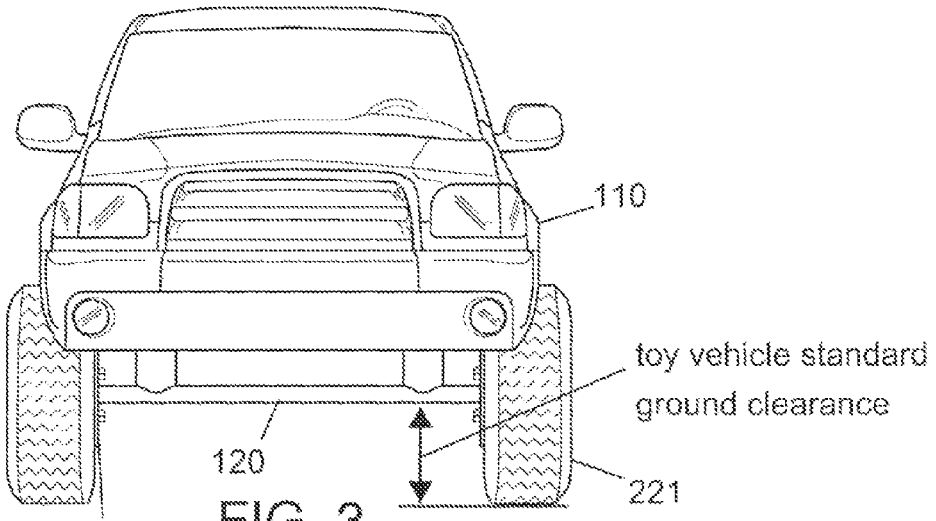
FIG. 3 shows a front view of the present invention featuring the toy vehicle standard ground clearance
Figure 4:
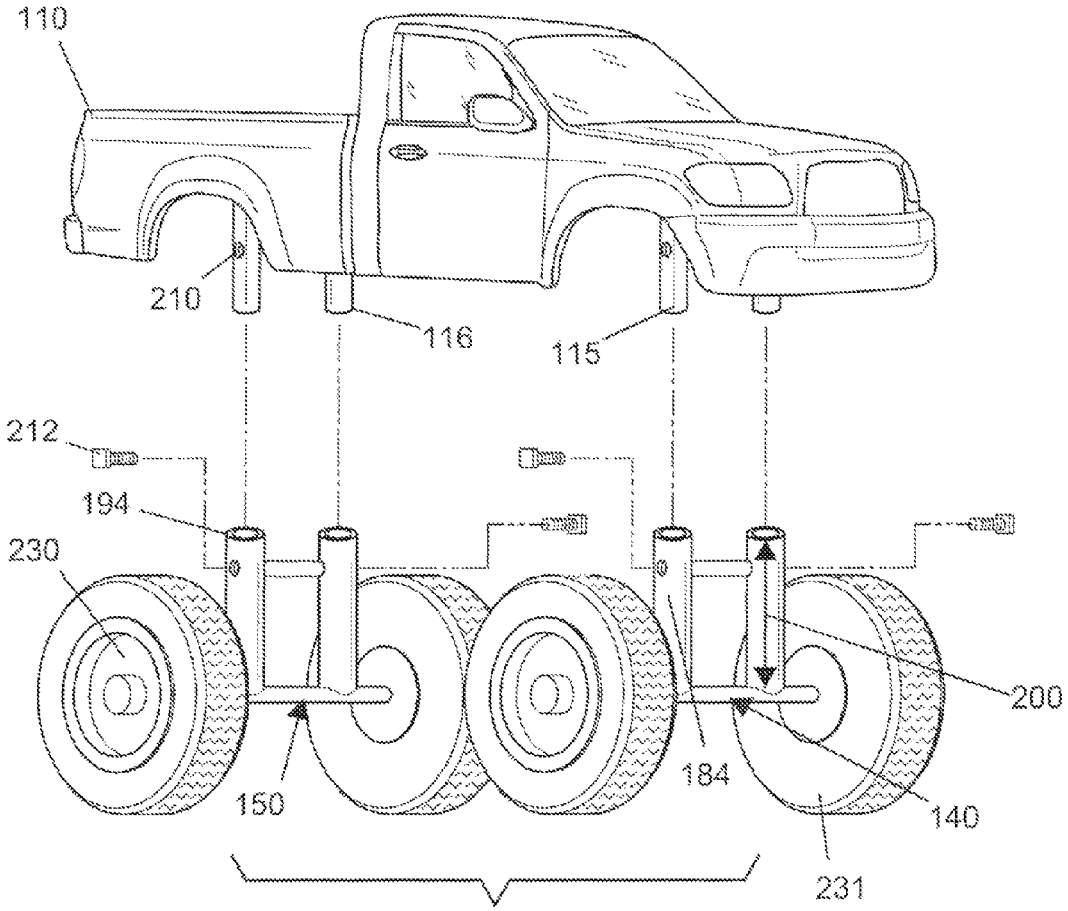
FIG. 4 shows a perspective view of the present invention featuring the toy vehicle second ground clearance.
Figure 5:
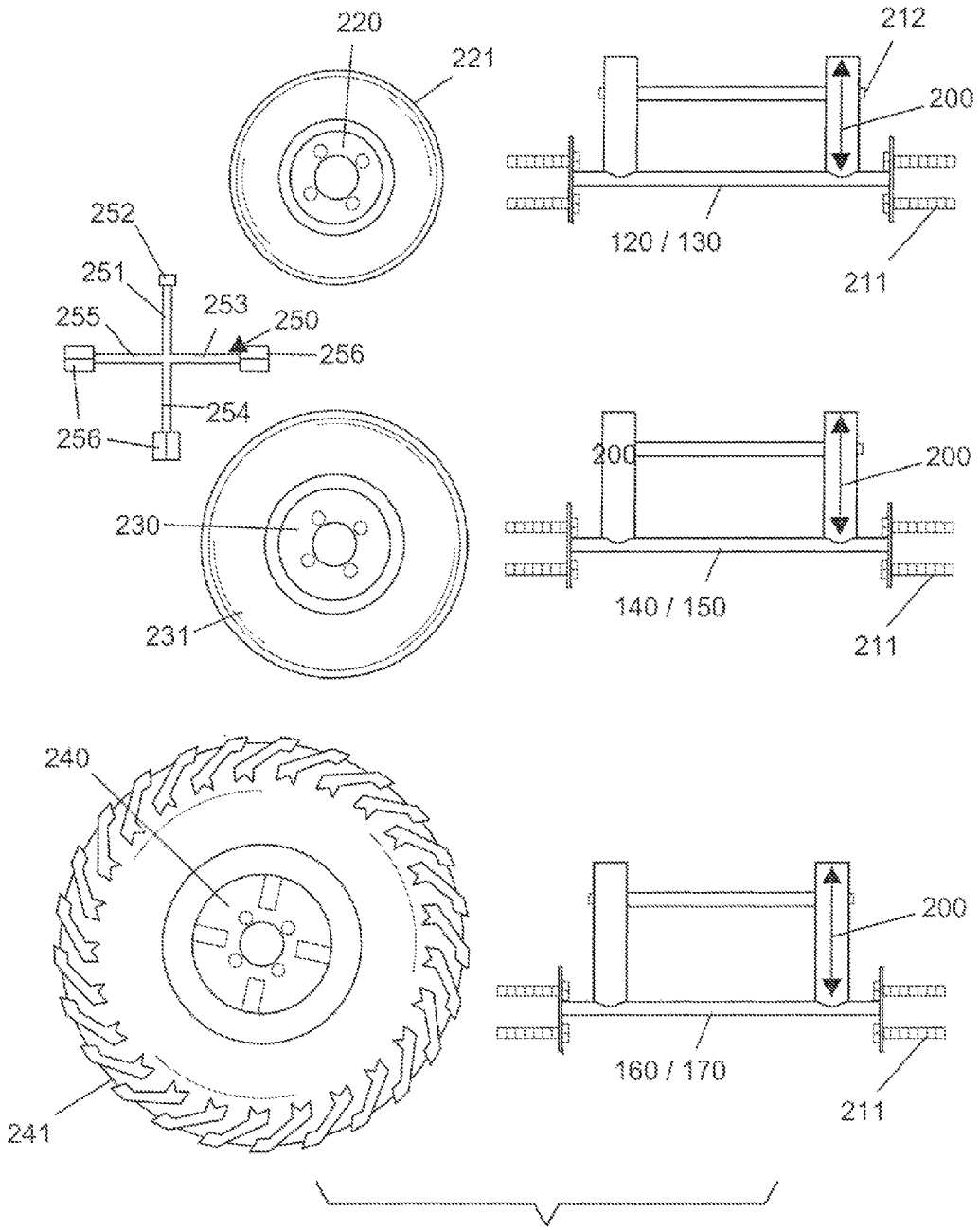
FIG. 5 shows an overview of the components of the present invention for changing the ground clearance of the vehicle.

Following is a list of elements corresponding to a particular element referred to herein:

100 Toy vehicle system
110 Toy vehicle
111 Vehicle underside
112 Vehicle front
113 Vehicle rear
115 Anterior axle mount projection
116 Posterior axle mount projection
117 Axle mount projection sidewall
120 First anterior axle unit
130 First posterior axle unit
140 Second anterior axle unit
150 Second posterior axle unit
160 Third anterior axle unit
170 Third posterior axle unit
180 Anterior axle first hub
181 Anterior axle first end
182 Anterior axle second hub
183 Anterior axle second end
184 Anterior axle mount sleeve
185 Anterior axle support brace
186 Anterior axle support brace first end
187 First anterior axle mount sleeve side wall
188 Anterior axle support brace second end
189 Second anterior axle mount sleeve side wall
190 Posterior axle first hub
191 Posterior axle first end
192 Posterior axle second hub
193 Posterior axle second end
194 Posterior axle mount sleeve
195 Posterior axle support brace
196 Posterior axle support brace first end
197 First posterior axle mount sleeve side wall
198 Posterior axle support brace second end
199 Second posterior axle mount sleeve side wall
200 Sleeve length
210 Fastening aperture
211 Wheel stud
212 Fastener
213 Nut
220 First size wheel
221 First size tire
230 Second size wheel
231 Second size tire
240 Third size wheel
241 Third size tire
250 Wrench
251 First projection
252 Flat blade screwdriver
253 Second projection
254 Third projection
255 Fourth projection
256 Lug wrench Referring now to FIG. 1-5, the present invention features a toy vehicle system (100) having interchanging wheels, tires and axles for altering ground clearance for the vehicle with respect to an obstacle. In some embodiments, the system (100) comprises a toy vehicle (110) having a vehicle underside (111).

In some embodiments, the system (100) comprises a pair of anterior axle mount projections (115) angularly disposed on the vehicle underside (111) parallel to each other. In some embodiments, the pair of anterior axle mount projections (115) is disposed proximal to a vehicle front (112). In some embodiments, each anterior axle mount projection (115) comprises a fastening aperture (210) disposed on an axle mount projection sidewall (117) thereon. In some embodiments, the anterior axle mount projection (115) resembles a cylindrical rod.

In some embodiments, the system (100) comprises a pair of posterior axle mount projections (116) angularly disposed on the vehicle underside (111) parallel to each other. In some embodiments, the pair of posterior axle mount projections (116) is disposed proximal to a vehicle rear (113). In some embodiments, each posterior axle mount projection (116) comprises a fastening aperture (210) disposed on the axle mount projection sidewall (117) thereon. In some embodiments, the posterior axle mount projection (116) resembles a cylindrical rod.

In some embodiments, the system (100) comprises a first anterior axle unit (120) and a first posterior axle unit (130). In some embodiments, the first anterior axle unit (120) and the first posterior axle unit (130) are designed to position the toy vehicle (110) at a toy vehicle standard ground clearance that proportionally resembles a full size vehicle standard ground clearance.

In some embodiments, the full size vehicle standard ground clearance is less than 3 inches. In some embodiments, the full size vehicle standard ground clearance is between 3-4 inches. In some embodiments, the full size vehicle standard ground clearance is between 4-6 inches. In some embodiments, the full size vehicle standard ground clearance is between 6-8 inches. In some embodiments, the full size vehicle standard ground clearance is between 8-12 inches or greater.

In some embodiments, the first anterior axle unit (120), a second anterior axle unit (140), and a third anterior axle unit (160) each comprise an anterior axle first hub (180) rotatably disposed on an anterior axle first end (181) and an anterior axle second hub (182) rotatably disposed on an anterior axle second end (183). In some embodiments, the anterior axle second end (183) is opposed to the anterior axle first end (181).

In some embodiments, a pair of anterior axle mount sleeves (184) is angularly disposed parallel to each other on the first anterior axle unit (120), the second anterior axle unit (140), or the third anterior axle unit (160). In some embodiments, the pair of anterior axle mount sleeves (184) resembles tubes or piping. In some embodiments, the anterior axle mount sleeves (184) are designed to slidably insert over and fasten to the anterior axle mount projections (115). In some embodiments, an anterior axle support brace (185) is disposed parallel to and offset from the first anterior axle unit (120), the second anterior axle unit (140), or the third anterior axle unit (160) having an anterior axle support brace first end (186) disposed on a first anterior axle mount sleeve side wall (187) and an anterior axle support brace second end (188) disposed on a second anterior axle mount sleeve side wall (189). In some embodiments, a pair of first anterior axle mount sleeves (184) comprises a sleeve length (200) designed to position the toy vehicle (110) at a toy vehicle standard ground clearance that proportionally resembles a full size vehicle standard ground clearance.

In some embodiments, the sleeve length (200) is ¼" or less. In some embodiments, the sleeve length (200) is ¼" to ½". In some embodiments, the sleeve length (200) is ½ to ¾". In some embodiments, the sleeve length (200) is ¾" or greater.

In some embodiments, each anterior axle mount sleeve (184) comprises a fastening aperture (210) disposed through a first anterior axle mount sleeve side wall (187) or a second anterior axle mount sleeve side wall (189) thereon. In some embodiments, a plurality of wheel studs (211) is radially disposed on each of the anterior axle first hub (180) and the anterior axle second hub (182). In some embodiments, there are four wheel studs (211). In some embodiments, there are five wheel studs (211).

In some embodiments, the first posterior axle unit (130), a second posterior axle unit (150), and a third posterior axle unit (170) each comprise a posterior axle first hub (190) rotatably disposed on a posterior axle first end (191) and a posterior axle second hub (192) rotatably disposed on a posterior axle second end (193). In some embodiments, the posterior axle second end (193) is opposed to the posterior axle first end (191).

In some embodiments, a pair of posterior axle mount sleeves (194) is angularly disposed parallel to each other on the first posterior axle unit (130), the second posterior axle unit (150), or the third posterior axle unit (170). In some embodiments, the posterior axle mount sleeves (194) are designed to slidably insert over and fasten to the posterior axle mount projection (116). In some embodiments, a posterior axle support brace (195) is disposed parallel to and offset from the first posterior axle unit (130), the second posterior axle unit (150), or the third posterior axle unit (170) having a posterior axle support brace first end (196) disposed on a first posterior axle mount sleeve side wall (197) and a posterior axle support brace second end (198) of the posterior axle support brace (195) disposed on a second posterior axle mount sleeve side wall (199). In some embodiments, a pair of first posterior axle mount sleeves (194) comprises a sleeve length (200) designed to position the toy vehicle (110) at a toy vehicle standard ground clearance that proportionally resembles a full size vehicle standard ground clearance.

In some embodiments, each posterior axle mount sleeve (194) comprises the fastening aperture (210) disposed through a first posterior axle mount sleeve side wall (197) and a second posterior axle mount sleeve side wall (199) thereon. In some embodiments, a plurality of wheel studs (211) is radially disposed on each of the posterior axle first hub (190) and the posterior axle second hub (192).

In some embodiments, the system (100) comprises a second anterior axle unit (140) and a second posterior axle unit (150). In some embodiments, the second anterior axle unit (140) and the second posterior axle unit (150) are designed to position the toy vehicle (110) at a toy vehicle second ground clearance that proportionally resembles a full size vehicle second ground clearance. In some embodiments, the toy vehicle second ground clearance is at least fifty percent greater than the toy vehicle standard ground clearance. In some embodiments, a pair of second anterior axle mount sleeves (184) comprises the sleeve length (200) designed to position the toy vehicle (110) at a toy vehicle second ground clearance that proportionally resembles a full size vehicle second ground clearance. In some embodiments, a pair of second posterior axle mount sleeves (194) comprises the sleeve length (200) designed to position the toy vehicle (110) at the toy vehicle second ground clearance that proportionally resembles the full size vehicle second ground clearance.

In some embodiments, the system (100) comprises a third anterior axle unit (160) and a third posterior axle unit (170). In some embodiments, the third anterior axle unit (160) and the third posterior axle unit (170) are designed to position the toy vehicle (110) at a toy vehicle third ground clearance that proportionally resembles a full size vehicle third ground clearance. In some embodiments, the toy vehicle third ground clearance is at least fifty percent greater than the toy vehicle second ground clearance. In some embodiments, a pair of third anterior axle mount sleeves (184) comprises the sleeve length (200) designed to position the toy vehicle (110) at a toy vehicle third ground clearance that proportionally resembles the full size vehicle third ground clearance. In some embodiments, the pair of third posterior axle mount sleeves (194) comprises the sleeve length (200) designed to position the toy vehicle (110) at the toy vehicle third ground clearance that proportionally resembles the full size vehicle third ground clearance.

In some embodiments, the system (100) comprises a plurality of first size wheels (220) each having a first size tire (221) disposed on an outer periphery thereon. In some embodiments, the plurality of first size wheels and tires are designed to position the toy vehicle (110) at the toy vehicle standard ground clearance that proportionally resembles the full size vehicle standard ground clearance.

In some embodiments, the system comprises a plurality of second size wheels (230), each having a second size tire (231) disposed on an outer periphery thereon. In some embodiments, the plurality of second size wheels (230) and tires (231) is designed to position the toy vehicle (110) at the toy vehicle second ground clearance that proportionally resembles the full size vehicle second ground clearance.

In some embodiments, the system (100) comprises a plurality of third size wheels (240), each having a third size tire (241) disposed on an outer periphery thereon. In some embodiments, the plurality of third size wheels (240) and tires (241) is designed to position the toy vehicle (110) at the toy vehicle third ground clearance that proportionally resembles the full size vehicle third ground clearance.

In some embodiments, the system (100) comprises a plurality of fasteners (212). In some embodiments, each fastener (212) is designed to pass through the fastening aperture (210) and the fastening aperture (210) for securing the first anterior axle unit (120), the second anterior axle unit (140), the third anterior axle unit (160), the first posterior axle unit (130), the second posterior axle unit (150), or the third posterior axle unit (170) to the anterior axle mount projection (115) or the posterior axle mount projection (116).

In some embodiments, the system (100) comprises a plurality of nuts (213). In some embodiments, a nut is disposed on a wheel stud (211) for securing a first size wheel (220), a second size wheel (230), or a third size wheel (240) on the anterior axle first hub (180), the anterior axle second hub (182), the posterior axle first hub (190), or the posterior axle second hub (192).

In some embodiments, the system comprises a perpendicular wrench (250) having four projections disposed thereon, radially projecting from a central hub. In some embodiments, a first projection (251) comprises a flat blade screwdriver (252) disposed on terminating end thereon for interfacing with the plurality of fasteners (212). In some embodiments, the second projection (253), the third projection (254), and the fourth projection (255) each comprise a lug wrench (256) dispossessed on a terminating end thereon for interfacing with the plurality of nuts (213).

In some embodiments, the first anterior axle unit (120), the first posterior axle unit (130), and the plurality of first size wheels (220) are disposed on the toy vehicle (110) thereon. In some embodiments, alternately, the second anterior axle unit (140), the second posterior axle unit (150), and the plurality of second size wheels (230) are disposed on the toy vehicle (110) thereon. In some embodiments, alternately, the third anterior axle unit (160), the third posterior axle unit (160), and the plurality of third size wheels (240) are disposed on the toy vehicle (110) thereon.

In some embodiments, the toy vehicle standard ground clearance is less than ¼" from the vehicle underside (111) to a ground surface.

In some embodiments, the toy vehicle standard ground clearance is about ½" from the vehicle underside (111) to a ground surface.

In some embodiments, the toy vehicle standard ground clearance is about ¾" from the vehicle underside (111) to a ground surface.

In some embodiments, the toy vehicle standard ground clearance is 1" or more from the vehicle underside (111) to a ground surface.

As used herein, the term "about" refers to plus or minus 10% of the referenced number.

The disclosures of the following U.S. Patents are incorporated in their entirety by reference herein: U.S. Pat. No. D 305,555; U.S. Patent Pub. No. 2009/0036018; U.S. Pat. No. 6,764,376; U.S. Pat. No. 5,785,576; U.S. Pat. No. 4,850,929; U.S. Pat. No. 4,822,316; and U.S. Pat. No. 4,696,655;

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A toy vehicle system (100) having interchanging wheels, tires and axles for altering ground clearance for the vehicle with respect to an obstacle, wherein the system (100) comprises:

(a) a toy vehicle (110) having a vehicle underside (111);

(b) a pair of anterior axle mount projections (115) angularly disposed on the vehicle underside (111) parallel to each other, wherein the pair of anterior axle mount projections (115) is disposed proximal to a vehicle front (112), wherein each anterior axle mount projection (115) comprises a fastening aperture (210) disposed on an axle mount projection sidewall (117) thereon;

(c) a pair of posterior axle mount projections (116) angularly disposed on the vehicle underside (111) parallel to each other, wherein the pair of posterior axle mount projections (116) is disposed proximal to a vehicle rear (113), wherein each posterior axle mount projection (116) comprises the fastening aperture (210) disposed on the axle mount projection sidewall (117) thereon;

(d) a first anterior axle unit (120) and a first posterior axle unit (130), wherein the first anterior axle unit (120) and the first posterior axle unit (130) are designed to position the toy vehicle (110) at a toy vehicle standard ground clearance that proportionally resembles a full size vehicle standard ground clearance;

wherein the first anterior axle unit (120), a second anterior axle unit (140), and a third anterior axle unit (160) each comprise an anterior axle first hub (180) rotatably disposed on an anterior axle first end (181) and an anterior axle second hub (182) rotatably disposed on an anterior axle second end (183), wherein the anterior axle second end (183) is opposed to the anterior axle first end (181), wherein a pair of anterior axle mount sleeves (184) is angularly disposed parallel to each other on the first anterior axle unit (120), the second anterior axle unit (140), or the third anterior axle unit (160), wherein the anterior axle mount sleeves (184) are designed to slidably insert over and fasten to the anterior axle mount projections (115), wherein an anterior axle support brace (185) is disposed parallel to and offset from the first anterior axle unit (120), the second anterior axle unit (140), or the third anterior axle unit (160) having an anterior axle support brace first end (186) disposed on a first anterior axle mount sleeve side wall (187) and an anterior axle support brace second end (188) disposed on a second anterior axle mount sleeve side wall (189), wherein the pair of first anterior axle mount sleeves (184) comprises a standard sleeve length (200) designed to position the toy vehicle (110) at the toy vehicle standard ground clearance that proportionally resembles the full size vehicle standard ground clearance, wherein each anterior axle mount sleeve (184) comprises a fastening aperture (210) disposed through the first anterior axle mount sleeve side wall (187) or the second anterior axle mount sleeve side wall (189) thereon, wherein a plurality of wheel studs (211) is radially disposed on each of the anterior axle first hub (180) and the anterior axle second hub (182), wherein the first posterior axle unit (130), a second posterior axle unit (150), and a third posterior axle unit (170) each comprise a posterior axle first hub (190) rotatably disposed on a posterior axle first end (191) and a posterior axle second hub (192) rotatably disposed on a posterior axle second end (193), wherein the posterior axle second end (193) is opposed to the posterior axle first end (191), wherein a pair of posterior axle mount sleeves (194) is angularly disposed parallel to each other on the first posterior axle unit (130), the second posterior axle unit (150), or the third posterior axle unit (170), wherein the posterior axle mount sleeves (194) are designed to slidably insert over and fasten to the posterior axle mount projection (116), wherein a posterior axle support brace (195) is disposed parallel to and offset from the first posterior axle unit (130), the second posterior axle unit (150), or the third posterior axle unit (170) having a posterior axle support brace first end (196) disposed on a first posterior axle mount sleeve side wall (197) and a posterior axle support brace second end (198) disposed on a second posterior axle mount sleeve side wall (199), wherein the pair of first posterior axle mount sleeves (194) comprises the standard sleeve length (200) designed to position the toy vehicle (110) at the toy vehicle standard ground clearance that proportionally resembles the full size vehicle standard ground clearance, wherein each posterior axle mount sleeve (194) comprises a fastening aperture (210) disposed through the first posterior axle mount sleeve side wall (197) and the second posterior axle mount sleeve side wall (199) thereon, wherein a plurality of wheel studs (211) is radially disposed on each of the posterior axle first hub (190) and the posterior axle second hub (192);

(e) the second anterior axle unit (140) and the second posterior axle unit (150), wherein the second anterior axle unit (140) and the second posterior axle unit (150) are designed to position the toy vehicle (110) at a toy vehicle second ground clearance that proportionally resembles a full size vehicle second ground clearance, wherein the toy vehicle second ground clearance is at least fifty percent greater than the toy vehicle standard ground clearance, wherein a pair of second anterior axle mount sleeves (184) comprises a second sleeve length (200) designed to position the toy vehicle (110) at the toy vehicle second ground clearance that proportionally resembles the full size vehicle second ground clearance, wherein a pair of second posterior axle mount sleeves (194) comprises the second sleeve length (200) designed to position the toy vehicle (110) at the toy vehicle second ground clearance that proportionally resembles the full size vehicle second ground clearance;

(f) the third anterior axle unit (160) and the third posterior axle unit (170), wherein the third anterior axle unit (160) and the third posterior axle unit (170) are designed to position the toy vehicle (110) at a toy vehicle third ground clearance that proportionally resembles a full size vehicle third ground clearance, wherein the toy vehicle third ground clearance is at least fifty percent greater than the toy vehicle second ground clearance, wherein a pair of third anterior axle mount sleeves (184) comprises a third sleeve length (200) designed to position the toy vehicle (110) at the toy vehicle third ground clearance that proportionally resembles the full size vehicle third ground clearance, wherein the pair of third posterior axle mount sleeves (194) comprises the third sleeve length (200) designed to position the toy vehicle (110) at the toy vehicle third ground clearance that proportionally resembles the full size vehicle third ground clearance;

(g) a plurality of first size wheels (220) each having a first size tire (221) disposed on an outer periphery thereon, wherein the plurality of first size wheels and tires is designed to position the toy vehicle (110) at the toy vehicle standard ground clearance that proportionally resembles the full size vehicle standard ground clearance;

(h) a plurality of second size wheels (230), each having a second size tire (231) disposed on an outer periphery thereon, wherein the plurality of second size wheels (230) and tires (231) is designed to position the toy vehicle (110) at the toy vehicle second ground clearance that proportionally resembles the full size vehicle second ground clearance;

(i) a plurality of third size wheels (240), each having a third size tire (241) disposed on an outer periphery thereon, wherein the plurality of third size wheels (240) and tires (241) is designed to position the toy vehicle (110) at the toy vehicle third ground clearance that proportionally resembles the full size vehicle third ground clearance;

(j) a plurality of fasteners (212), wherein each fastener (212) is designed to pass through the fastening apertures (210) for securing the first anterior axle unit (120), the second anterior axle unit (140), the third anterior axle unit (160), the first posterior axle unit (130), the second posterior axle unit (150), or the third posterior axle unit (170) to the anterior axle mount projection (115) or the posterior axle mount projection (116);

(k) a plurality of nuts (213), wherein a nut is disposed on the wheel stud (211) for securing the first size wheel (220), the second size wheel (230), or the third size wheel (240) on the anterior axle first hub (180), the anterior axle second hub (182), the posterior axle first hub (190), or the posterior axle second hub (192); and (l) a perpendicular wrench (250) having four projections disposed thereon, radially projecting from a central hub, wherein a first projection (251) comprises a flat blade screwdriver (252) disposed on terminating end thereon for interfacing with the plurality of fasteners (212), wherein a second projection (253), a third projection (254), and a fourth projection (255) each comprise a lug wrench (256) dispossessed on a terminating end thereon for interfacing with the plurality of nuts (213);

wherein the first anterior axle unit (120), the first posterior axle unit (130), and the plurality of first size wheels (220) are disposed on the toy vehicle (110) thereon, wherein alternately, the second anterior axle unit (140), the second posterior axle unit (150), and the plurality of second size wheels (230) are disposed on the toy vehicle (110) thereon, wherein alternately, the third anterior axle unit (160), the third posterior axle unit (160), and the plurality of third size wheels (240) are disposed on the toy vehicle (110) thereon.

2. The system (100) of claim 1, wherein the toy vehicle standard ground clearance is less than ¼" from the vehicle underside (111) to a ground surface.

3. The system (100) of claim 1, wherein the toy vehicle standard ground clearance is about ½" from the vehicle underside (111) to a ground surface.

4. The system (100) of claim 1, wherein the toy vehicle standard ground clearance is about ¾" from the vehicle underside (111) to a ground surface.

5. The system (100) of claim 1, wherein the toy vehicle standard ground clearance is 1" or more from the vehicle underside (111) to a ground surface.

* * * * *